United States Patent [19]

Golovich

[11] 4,197,626

[45] Apr. 15, 1980

[54] TOOL FOR INTERLOCKING SIDING

[76] Inventor: Richard F. Golovich, Box 5 Heckert Rd., Bakerstown, Pa. 15007

[21] Appl. No.: 947,346

[22] Filed: Oct. 2, 1978

[51] Int. Cl.[2] ..... B25B 27/00

[52] U.S. Cl. ..... 29/270; 29/235

[58] Field of Search ..... 29/270, 278, 235, 238, 29/239, 243.5; 81/3 R; 145/1 R, 1 A

[56] References Cited

U.S. PATENT DOCUMENTS

| | | | |
|---|---|---|---|
| 658,956 | 10/1900 | Maurice | 145/1 A |
| 2,330,023 | 9/1943 | Balousek | 29/270 |
| 2,576,262 | 11/1951 | Morehead | 29/270 |
| 3,359,620 | 12/1967 | Hunter | 29/270 |
| 3,508,319 | 4/1970 | Boyer | 29/235 |

*Primary Examiner*—James L. Jones, Jr.
*Attorney, Agent, or Firm*—William J. Ruano

[57] ABSTRACT

A tool for effecting interlocking of the flanges of adjoining siding elements after such elements have been sprung apart for insertion of insulation between the siding and building. The tool has a unique shape to effect progressive camming of one of the interlocking flanges in relationship to the other until the interlocking flanges are moved so close together as to spring in interlocking relationship.

1 Claim, 4 Drawing Figures

TOOL FOR INTERLOCKING SIDING

This invention relates to a tool for assembling metal siding.

In the past, when it was desired to disassemble metal siding to put insulation between it and a house or building, great difficulty was encountered in reconnecting the longitudinal edges of the metal siding. Sometimes the edges were forced together in a manner as to injure the longitudinal edges and lower the strength of the joints, particularly at the edges.

An object of my invention is to provide a novel tool of such unique shape as to spring the longitudinal edges of the siding into engagement with each other after insulation has been installed between the siding and the building.

Another object of the invention is to provide a novel tool of such shape that it may be guided by the longitudinal edges of the siding and, at the same time, bring the edges into progressively closer contact until they finally spring together in tight interlocking position.

Other objects and advantages will become more apparent from a study of the following description, together with the accompanying drawing wherein.

Figure 1:
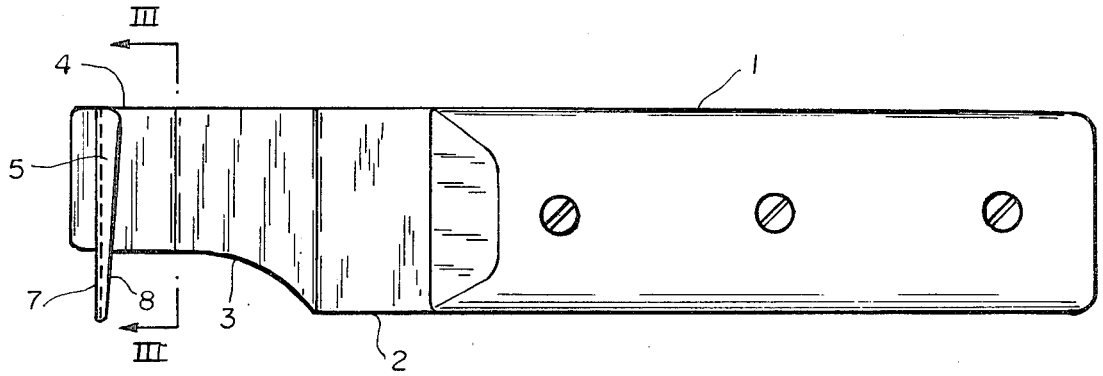
FIG. 1 is a top view and FIG. 2 is a side view of the tool embodying my invention.
Figure 2:
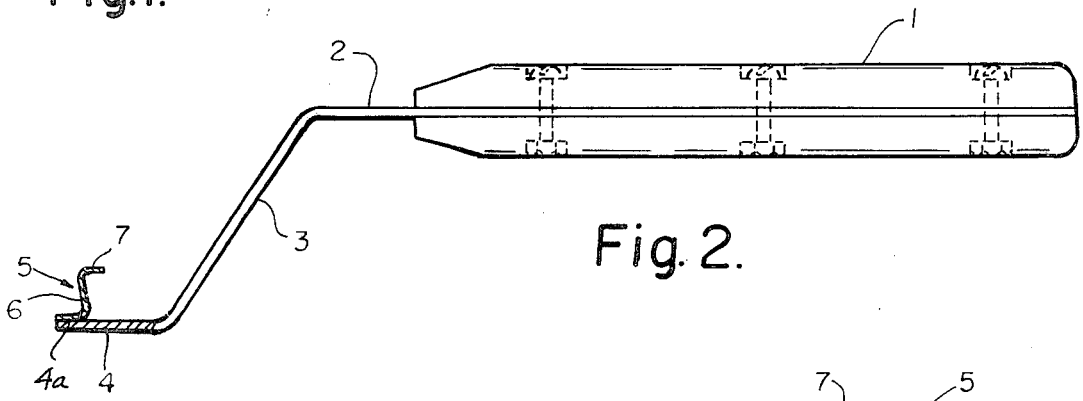
Figure 3:
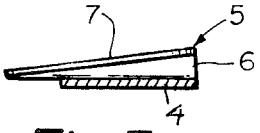
FIG. 3 is a cross-sectional view taken along line III—III of FIG. 1.

Referring more particularly to the drawing, numeral 2 denotes a strip of steel or other suitable metal having a handle 1 clamped to an end portion thereof and having a laterally offset portion 3 and 4, the latter being reversely bent at 4*a* to form a guide portion and which extends laterally at 6 and being flanged at 7 to form a camming portion. Flange 7 is downwardly tapered, as shown in FIG. 3, to form a wedge shaped camming portion for pulling together adjoining flanges of adjoining siding.

The invention will be more clearly understandable after the following description of a siding joint is set forth to more clearly illustrate the operation of the tool.

Figure 4:
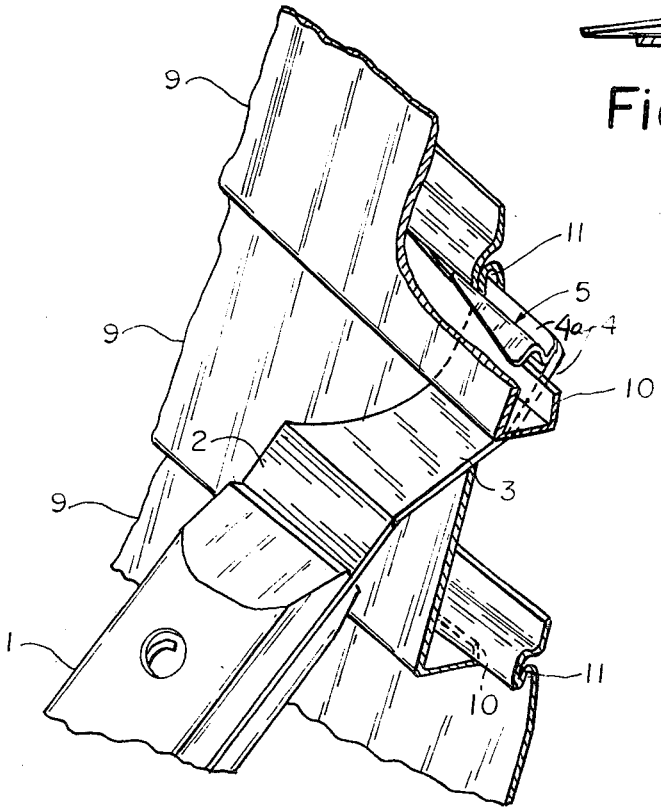
FIG. 4 is a perspective view of the tool as applied to metal siding, shown in cross-section.

Referring more particularly to FIG. 4, siding elements 9 are illustrated in their separated and partially engaged position, aided by the tool of the present invention, such as occurs after they were pulled apart at the adjoining longitudinal edges in order to allow installation of insulation to be introduced between the siding and the building (not shown). The tool of the present invention is shown intermediate said complementary and adjoining longitudinal edges 10 and 11 of the siding. It will readily appear that the reversely bent edge or flange portion has a well serving as a guide portion in which the guide portion 4*a* of the tool is slid along. Therefore, as the tool is moved from left to right, as viewed in FIG. 4, the downturned top flange 7 which has a flat plane surface slides on flange 10 will cause flange 10 to progressively come closer and closer to the upstanding bottom flange 11 of the adjoining siding 9 by virtue of the wedge shape of the flange 7 of the tool until the left end of 7 as viewed in FIG. 3, projects immediately below flange 11 of the adjoining siding, in which event the springiness of such adjoining flanges will allow flange 10 to spring into the well of guide flange 11 of the adjoining siding and thereby become interlocked therewith.

In short, as the tool is moved from left to right, as viewed in FIG. 4, the wedge shaped flange 7, which is a camming surface, will progressively pull the top flange 10, against which it slides, towards the building until it approaches the well portion of flange 11, in which event, the natural springiness of the bent adjoining flanges 10 and 11 will cause them to suddenly interlock in place in the manner shown at the lower part of FIG. 4. It will be noted that portion 6 is somewhat curved to reduce sliding friction with guide portion 4*a*. It will also be noted that all the corner portions of the tool flanges are rounded. The reversely bent guide portion 4*a* may be spot welded to maintain an integral relationship.

While dimensions are not critical, certain operable dimensions may be as follows: The thickness of the tool steel may be 1/32 inch, A maximum separation between flange 7 and portion 4 may be $\frac{3}{8}$ inch and the minimum separation about zero as will be apparent in FIG. 3. The height of flange 4*a* is slightly less than the depth of flange 11.

Thus it will be seen that I have provided a highly efficient tool which enables easy and quick interlocking of adjoining flanges of siding after insulation has been inserted between the siding and the building and which involves a minimum of mechanical effort to bring the adjoining flanges into progressively closer relationship and finally in interlocking engagement without damage to the interlocking parts.

While I have illustrated and described a single specific embodiment of my invention, it will be understood that this is by way of illustration only and that various changes and modifications may be contemplated in my invention and within the scope of the following claims.

I claim:

1. A tool for progressively bringing together and interlocking the longitudinal flanges of adjoining siding elements of a building, said tool comprising a strip of metal having, at one end, an elongated handle portion adjoining a portion extending at an obtuse angle thereto which, in turn, adjoins a lower portion which is parallel to said handle portion and a portion which is reversely bent with contacting parts welded and which adjoins an upstanding portion from said lower portion of right triangular outline transversely of said strip, said upstanding portion having an apex portion of said triangular portion extending beyond the side edge of said lower portion, said triangular portion being flanged at the top throughout one entire side, whereby said reversely bent portion will progressively slide against the side of the flange of a longitudinal channel of the adjoining siding element until interlocking relationships is achieved between said longitudinal flange and channel, and a pair of grips fastened on both sides of said handle portion.

* * * * *